US006566317B2

(12) United States Patent
Morris et al.

(10) Patent No.: US 6,566,317 B2
(45) Date of Patent: May 20, 2003

(54) PROCESS FOR INHIBITING GEL FORMATION OF HYDRATED DETERGENT TABLETS CONTAINING NONIONIC SURFACTANT ETHOXYLATES

(75) Inventors: Timothy C. Morris, Morton, PA (US); Robert J. Valesky, Hatboro, PA (US); Stephen F. Gross, Souderton, PA (US); Charles B. Allen, Clinton, NJ (US)

(73) Assignee: Cognis Corporation, Cincinnati, OH (US)

( * ) Notice: Subject to any disclaimer, the term of this patent is extended or adjusted under 35 U.S.C. 154(b) by 0 days.

(21) Appl. No.: 09/829,455

(22) Filed: Apr. 10, 2001

(65) Prior Publication Data

US 2001/0051598 A1 Dec. 13, 2001

Related U.S. Application Data

(60) Provisional application No. 60/199,425, filed on Apr. 25, 2000.

(51) Int. Cl.[7] ..... C11D 17/00; C11D 1/72; C11D 1/722; C11D 3/22

(52) U.S. Cl. ..... 510/298; 510/356; 510/421; 510/446; 510/470; 510/506; 510/535

(58) Field of Search ..... 510/298, 356, 510/357, 421, 422, 424, 446, 470, 506, 495, 535

(56) References Cited

U.S. PATENT DOCUMENTS

| | | | | | |
|---|---|---|---|---|---|
| 4,368,147 | A | * | 1/1983 | Inamorato et al. | 510/340 |
| 5,124,066 | A | * | 6/1992 | Russell | 510/321 |
| 5,219,495 | A | * | 6/1993 | Hsu | 510/357 |
| 5,266,690 | A | | 11/1993 | McCurry, Jr. et al. | 536/18.6 |
| 5,382,377 | A | | 1/1995 | Raehse et al. | 510/445 |
| 5,759,979 | A | * | 6/1998 | Schmid et al. | 510/237 |
| 5,789,370 | A | | 8/1998 | Thomas et al. | 510/424 |
| 5,827,453 | A | | 10/1998 | Gross et al. | 252/321 |
| 5,858,957 | A | * | 1/1999 | Donoghue et al. | 510/445 |
| 5,900,399 | A | | 5/1999 | Seiter et al. | 510/446 |
| 6,235,703 | B1 | * | 5/2001 | Appel et al. | 510/444 |
| 6,313,080 | B1 | * | 11/2001 | Boskamp et al. | 510/298 |

FOREIGN PATENT DOCUMENTS

| | | | |
|---|---|---|---|
| DE | 2219620 A | * | 11/1972 |
| EP | 0662511 A | * | 12/1995 |
| EP | 0711827 A | * | 5/1996 |
| WO | WO 99/40171 | | 8/1999 |
| WO | WO 99/42556 | | 8/1999 |

* cited by examiner

*Primary Examiner*—Lorna M. Douyon
(74) *Attorney, Agent, or Firm*—John E. Drach; Steven J. Trzaska

(57) ABSTRACT

A process for inhibiting gel formation of a tablet-form detergent composition upon hydration, the process involving: (a) providing a detergent composition containing a surfactant component selected from the group consisting of an anionic surfactant, a nonionic surfactant, and mixtures thereof; (b) providing an anti-gelling agent selected from the group consisting of an alkyl polyglycoside, a polymeric surfactant, an alkyl sulfate, and mixtures thereof; and (c) mixing the surfactant with the anti-gelling prior to introducing the tablet-form detergent composition into water.

36 Claims, No Drawings

PROCESS FOR INHIBITING GEL FORMATION OF HYDRATED DETERGENT TABLETS CONTAINING NONIONIC SURFACTANT ETHOXYLATES

CROSS-REFERENCE TO RELATED APPLICATIONS

This application claims the benefit of copending provisional application Ser. No. 60/199,425 filed on Apr. 25, 2000.

STATEMENT REGARDING FEDERALLY SPONSORED RESEARCH OR DEVELOPMENT

Not applicable.

BACKGROUND OF THE INVENTION

The present invention generally relates to a process for inhibiting gel formation of laundry detergent tablets containing anionic and/or nonionic surfactants, and particularly ethoxylated nonionic surfactants upon their introduction into water. More particularly, highly concentrated anionic and nonionic surfactants, and especially ethoxylated nonionic surfactants, when dispersed in water, tend to form highly viscous gels. Gel formation is immediate, particularly when linear alcohol ethoxylates having a high ethylene oxide content are hydrated.

This gel formation can significantly inhibit the complete hydration and dispersion of an anionic and/or nonionic surfactant, and particularly an ethoxylated nonionic surfactant, in solution. Since detergents used for various types of cleaning processes, such as the laundering of clothes, require rapid dispersion of the surfactant in water in order to realize optimal cleaning effect, it is imperative that an effective solution to this gelling phenomenon be found.

Reducing the gelling tendency of anionic and nonionic surfactants, especially nonionic ethoxylates such as LAE and NPE present in detergent compositions, is important for various cleaning product applications. In heavy duty laundry powders and liquids, surfactant gelling slows down the dissolution rate of the detergent composition, resulting in poor cleaning performance and residues.

This problem is particularly acute with respect to laundry detergents in tablet form. Two types of laundry detergent tablet formulations are becoming popular with consumers, namely, detergent tablets in solid form and those which contain a concentrated liquid inside a soluble outer shell/covering made, for example, from a cellulosic material. The popularity of these types of laundry detergent tablet formulations is already growing quickly in Europe, and similar products are currently being introduced in the US and throughout the world. However, due to the high concentration of anionic and/or nonionic surfactants present in these tablet formulations, surfactant gelling caused by hydration of these surfactants upon exposure to water inhibits1) in the case of solid tablets, the direct contact of the water with the disintegration agents contained in the solid tablet formulations used to facilitate the swelling and break up of the tablet for rapid dissolution, 2) in the case of liquid tablets, the rapid and complete dispersion of the product formulation in the wash liquor. In either case, the tablet dissolution can be incomplete resulting in poor product performance and unwanted residues in the wash tub and on the consumer's laundry.

In the case of solid tablets, these surfactants, especially nonionic ethoxylates, when hydrated will gel and encapsulate the disintegration agents. These disintegration agents (e.g. swelling cellulosic polymers), however, require contact with water in order to expand/swell. Therefore it is important to reduce or eliminate the gelling affect of these anionic and/or nonionic surfactants.

As was alluded to above, liquid laundry "Tablets" or pouches are the newest laundry detergent products recently launched in Europe. These laundry detergent pouches are based on highly active surfactant systems, typically nonionic based, with minimal water content. Reducing the gelling tendency of these products upon hydration is critical to optimal cleaning.

Finally, with respect to processing aids for aqueous based liquid surfactant products, surfactant gelling which occurs during the processing of liquid products will significantly slow down the process time, thus adding to its costs.

BRIEF SUMMARY OF THE INVENTION

The present invention is directed to a process for inhibiting tablet-form laundry detergents from gelling upon hydration involving the steps of: (a) providing a detergent formulation containing a surfactant selected from the group consisting of an anionic surfactant, a nonionic surfactant, and mixtures thereof; (b) providing an anti-gelling agent selected from the group consisting of an alkyl polyglycoside corresponding to formula I:

$$R^1O(Z)_a \quad \text{(I)}$$

wherein $R^1$ is a monovalent organic radical having from about 6 to about 30 carbon atoms; Z is a glucose residue; a is a number having a value from about 1 to about 6; a polymeric surfactant comprising at least one product of the reaction between:

(i) at least one linking agent of formula II:

$$R^2(Y)_3 \quad \text{(II)}$$

wherein each Y group is a halogen atom or one Y group is a halogen atom and two Y groups with two adjacent carbon atoms in the $R^2$ group and an oxygen atom form an epoxy group, and $R^2$ is an alkanetriyl group containing from 3 to 10 carbon atoms; and (ii) at least one compound of formula (III)

$$R^3(EO)_n(PO)_m(BO)_pX \quad \text{(III)}$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component (I) to component (ii) is from about 0.2/1 to about 5/1; an alkyl sulfate; and mixtures thereof; (c) combining the detergent formulation and the anti-galling agent to form a finished formulation and; (d) processing the finished formulation into a tablet-form laundry detergent product.

The present invention is also directed to a process for inhibiting an ethoxylated nonionic surfactant present in a cleaning composition from gelling upon hydration, the process involving:

(a) providing an ethoxylated nonionic surfactant;

(b) providing an anti-gelling agent selected from the group consisting of an alkyl polyglycoside corresponding to formula I:

$$R^1O(Z)_a \quad (I)$$

wherein $R^1$ is a monovalent organic radical having from about 6 to about 30 carbon atoms; Z is a glucose residue; a is a number having a value from about 1 to about 6; a polymeric surfactant comprising at least one product of the reaction between:

(i) at least one linking agent of formula II:

$$R^2(Y)_3 \quad (II)$$

wherein each Y group is a halogen atom or one Y group is a halogen atom and two Y groups with two adjacent carbon atoms in the $R^2$ group and an oxygen atom form an epoxy group, and $R^2$ is an alkanetriyl group containing from 3 to 10 carbon atoms; and (ii) at least one compound of formula (III)

$$R^3(EO)_n(PO)_m(BO)_pX \quad (III)$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component (i) to component (ii) is from about 0.2/1 to about 5/1; an alkyl sulfate; and mixtures thereof; and (c) mixing the ethoxylated nonionic surfactant with the anti-gelling agent.

BRIEF DESCRIPTION OF THE SEVERAL VIEWS OF THE DRAWING

Not applicable.

DETAILED DESCRIPTION OF THE INVENTION

Other than in the operating examples, or where otherwise indicated, all numbers expressing quantities of ingredients or reaction conditions are to be understood as being modified in all instances by the term "about".

The term "tablet-form" is meant to encompass concentrated laundry detergents in the form of solid tablets, concentrated liquid detergent formulations present inside a water-soluble outer covering, i.e., a pouch, and the like.

The present invention is directed to the surprising discovery that the gelling tendencies of concentrated anionic and/or nonionic surfactants, and particularly ethoxylated nonionic surfactants, when placed in water, can be significantly reduced by blending the surfactant(s) with the anti-gelling agent of the present invention.

Any type of anionic and/or nonionic surfactants, typically employed in detergent formulations, may be employed in the process of the present invention. However, particularly preferred surfactants are the nonionic ethoxylates. Examples thereof include, but are not limited to, linear alcohol ethoxylates having from about 8 to about 20 carbon atoms, preferably from about 10 to about 18 carbon atoms, and most preferably from about 12 to about 16 carbon atoms and from about 1 to about 20 moles of ethylene oxide, preferably from about 4 to about 16 moles of ethylene oxide, and most preferably from about 6 to about 12 moles of ethylene oxide, and nonyl-phenol ethoxylates having from about 1 to about 20 moles of ethylene oxide, preferably from about 4 to about 16 moles of ethylene oxide and most preferably from about 6 to about 12 moles of ethylene oxide, oxo-linear alcohols having from about 8 to about 20 carbon atoms, preferably from about 12 to about 15 carbon atoms, and from about 1 to about 20 moles of ethylene oxide, preferably from about 6 to about 12 moles of ethylene oxide, natural linear alcohols having from about 8 to about 20 carbon atoms, preferably from about 12 to about 16 carbon atoms, and from about 1 to about 20 moles of ethylene oxide, preferably from about 6 to about 12 moles of ethylene oxide.

Particularly preferred ethoxylated nonionic surfactants for use in the process of the present invention include a $C_{12-15}$ linear alcohol having 7 moles of ethylene oxide.

One of the anti-gelling agents for use in the present invention is an alkyl polyglycoside corresponding to formula I:

$$R^1O(Z)_a \quad I$$

wherein $R^1$ is a monovalent organic radical having from about 6 to about 30 carbon atoms; $R^2$ is a divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Cognis Corporation, Ambler, Pa., 19002. Examples of such surfactants include but are not limited to:

1. GLUCOPON® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.5.
3. GLUCOPON ® 625 Surfactant—an alkyl polyglycoside in which the alkyl group contains 12 to 16 carbon atoms and having an average degree of polymerization of 1.6.
4. APG® 325 Surfactant—an alkyl polyglycoside in which the alkyl group contains 9 to 11 carbon atoms and having an average degree of polymerization of 1.5.
5. GLUCOPON® 600 Surfactant—an alkyl polyglycoside in which the alkyl group contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.5.
7. PLANTAREN® 1300 Surfactant—a $C_{12-16}$ alkyl polyglycoside in which the alkyl group contains 12 to 16 carbon atoms and having an average degree of polymerization of 1.6.
8. GLUCOPON® 220 Surfactant—an alkyl polyglycoside in which the alkyl group contains 8 to 10 carbon atoms and having an average degree of polymerization of 1.5.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6 preferably from 1.4 to 1.7; b is zero; and $R^1$ is an alkyl radical having from 8 to 20 carbon atoms, preferably from 8 to 16 carbon atoms. The compositions are characterized in that they have increased surfactant properties and an HLB (hydrophile-lipophile balance) in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e., DP2 and DP3 fractions in relation to the sum of all DP fractions. Such compositions are disclosed in U.S. Pat. No. 5,266,690, the entire contents of which are incorporated herein by reference.

A particularly preferred alkyl polyglycoside for use in the present invention is one wherein in formula I $R^1$ is a monovalent organic radical having from about 8 to about 16 carbon atoms, and preferably from about 8 to about 11 carbon atoms, and a is a number having a value of from about 1.3 to about 1.6, and preferably about 1.5. It should be noted, however, that other types of nonionic sugar surfactants such as ethoxylated alkyl polyglycosides, glucamides, and the like might also be used without departing from the spirit of the invention.

Another anti-gelling agent used in the process of the present invention is a polymeric surfactant comprising at least one reaction product of the reaction between:

(i) at least one linking agent of formula II:

$$R^2(Y)_3 \qquad \text{(II)}$$

wherein each Y group is a halogen atom or one Y group is a halogen atom and two Y groups with two adjacent carbon atoms In the $R^2$ group and an oxygen atom form an epoxy group, and $R^2$ is an alkanetriyl group containing from 3 to 10 carbon atoms; and (ii) at least one compound of formula (III)

$$R^3(EO)_n(PO)_m(BO)_pX \qquad \text{(III)}$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component (i) to component (ii) is from about 0.2/1 to about 5/1.

The linking agent of formula (II) is preferably epichlorohydrin although other epihalohydrins can be used. Also, trihaloalkanes can be used, such as 1,2,3-trichloropropane, 1,2,4-trichlorobutane, 1,3,6-trichlorohexane and the like. Instead of chlorine in the epihalohydrins and the trihaloalkanes, the corresponding bromine and iodine compounds can also be used, including compounds containing two or even three of the above halogens.

In regard to formula III, the nonoxy and nonthio components of the $R^3$ aliphatic group can be any substituted or unsubstituted, saturated or unsaturated aliphatic moiety having from 1 to 36 carbon atoms. Thus, the nonthio and the nonoxy components of the $R^3$ aliphatic group can be linear or branched alkyl groups, linear or branched alkenyl or alkynyl groups, saturated carbocyclic moieties, unsaturated carbocyclic moieties having one or more multiple bonds, saturated heterocyclic moieties, unsaturated heterocyclic moieties having one or more multiple bonds, substituted linear or branched alkyl groups, substituted linear or branched alkenyl or alkynyl groups, substituted saturated carbocyclic moieties, substituted unsaturated carbocyclic moieties having one or more multiple bonds, substituted saturated heterocyclic moieties, and substituted unsaturated heterocyclic moieties having one or more multiple bonds. Examples of the above include but are not limited to an alkyl group having from 4 to 22 carbon atoms, an alkenyl group having from 4 to 22 carbon atoms, and an alkynyl group having from 4 to 22 carbon atoms. $R^3$ can also be an arenyl group. Arenyl groups are alkyl-substituted aromatic radicals having a free valence at an alkyl carbon atom such as a benzylic group. Alkyl groups having from 4 to 12 carbon atoms are preferred, and alkyl groups having from 8 to 10 carbon atoms are most preferred. The degree of ethoxylation is preferably from 2 to about 50 with the most preferred being from about 4 to about 50 while the degree of propoxylation and butoxylation can vary from 0 to about 50, preferably from 1 to about 10. The degree of propoxylation and or butoxylation will be determined by the desired degree of water solubility or miscibility. The water solubility or miscibility will ultimately be determined by such factors as the number of carbon atoms in $R^3$, the relative amounts EO, PO and BO and the effect of PO and BO on the biodegradability of the final composition.

When the X group of formula (III) is a mercapto group, the $R^3$ group will preferably have from about 4 to about 36 carbon atoms, n is from 0 to about 50, m is from 0 to about 50 and p is from 0 to about 50, examples of which include but are not limited to, alkoxylated dodecyl mercaptan and alkoxylated 1-hexadecanethiol.

The compounds of formula (III) can be alkoxylated or non-alkoxylated secondary amines. When the compounds of formula II are secondary amines, n is a number from 0 to 50, preferably from 1 to 50, m is a number from 0 to 50 and p is a number form 0 to 50, preferably from 1 to 50. Examples of the secondary amines useful for the purposes of the invention include but are not limited to, alkoxylated dibutyl amine, alkoxylated dicyclohexyl amine, alkoxylated diethylethanolamine, and alkoxylated dioctylamine.

Optionally an additional component can be reacted with the linking agent of formula (II) and the compound of formula (III). A glycidyl ether or amine can be added to the reaction of formula (II) and formula (III). The amount of the glycidyl ether or glycidyl amine is from about 1 to about 20 mole percent based on the moles of Formula (III) used in the reaction. When the glycidyl ether or glycidyl amine is added to the monofunctional starting material of formula III the ratio of formula II to Formula III plus the glycidyl ether or glycidyl amine is preferably from about 0.8 to about 1.4. Examples of the glycidyl ethers include, but are not limited to, PEG 600 Diglycidyl ether, TETRONIC™ 701 Tetraglycidyl ether, Triglycidyl Di or Triethanolamine, Polyoxyethylene (POE) 200 Tallow amine diglycidyl ether, Propoxylated (POP10) Trimethylol propane triglycidyl ether, Propoxylated (POP7) Pentaerythritol tetraglycidyl ether. Examples of Glycidyl amines include but are not limited to, Tetraglycidyl 1,6-Hexane diamine, Tetraglycidyl JEFFAMINE™ EDR-148, and Tetraglycidyl Isophorone diamine.

A particularly preferred polymeric surfactant for use in the present invention is the reaction product of a $C_{8-10}$ fatty alcohol having about 4.5 moles of ethylene oxide and epichlorohydrin commercially available from Cognis Corporation, Ambler Pa. under the name DEHYPOUND™ ST-15.

Alkyl sulfates may also be used as anti-gelling agents in order to inhibit the gelling of ethoxylated nonionic surfactants upon hydration. Examples of suitable alkyl sulfates include, but are not limited to, those having from about 8 to about 10 carbon atoms. A particularly preferred alkyl sulfate for use in the process of the present invention is octyl sulfate. In the event that an alkyl sulfate is used, it will typically be employed in a ratio by weight of ethoxylated nonionic surfactant to alkyl sulfate ranging from about 20:1 to about 1:1; from about 15:1 to about 1:1; from about 10:1 to about 1:1; and from about 5:1 to about 1:1.

According to one embodiment of the present invention there is provided a process for inhibiting anionic and/or nonionic surfactants, present in tablet-form laundry detergents. from gelling upon hydration, involving the steps of: (a) providing a detergent formulation containing a surfactant selected from the group consisting of an anionic surfactant, a nonionic surfactant, and mixtures thereof; (b) providing an anti-gelling agent selected from the group consisting of an alkyl polyglycoside corresponding to formula I:

$$R^1O(Z)_a \quad \text{(I)}$$

wherein $R^1$ is a monovalent organic radical having from about 6 to about 30 carbon atoms; Z is a glucose residue; a is a number having a value from about 1 to about 6; a polymeric surfactant comprising at least one product of the reaction between:

(i) at least one linking agent of formula II:

$$R^2(Y)_3 \quad \text{(II)}$$

wherein each Y group is a halogen atom or one Y group is a halogen atom and two Y groups with two adjacent carbon atoms in the $R^2$ group and an oxygen atom form an epoxy group, and $R^2$ is an alkanetriyl group containing from 3 to 10 carbon atoms; and (ii) at least one compound of formula (III)

$$R^3(EO)_n(PO)_m(BO)_pX \quad \text{(III)}$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component (i) to component (ii) is from about 0.2/1 to about 5/1; an alkyl sulfate; and mixtures thereof; (c) combining the detergent formulation and the anti-gelling agent to form a finished formulation and; (d) processing the finished formulation into a tablet-form laundry detergent product.

In the event that the anti-gelling agent selected is an alkyl polyglycoside, it will be mixed with the ethoxylated nonionic surfactant in a ratio by weight of ethoxylated nonionic surfactant to alkyl polyglycoside ranging from about 20:1 to about 1:1; from about 15:1 to about 1:1; from about 10:1 to about 1:1; and from about 5:1 to about 1:1.

Similarly, if the anti-gelling agent selected is the polymeric surfactant, it will be mixed with the ethoxylated nonionic surfactant in a ratio by weight of ethoxylated nonionic surfactant to polymeric surfactant ranging from about 50:1 to about 1:1; from about 20:1 to about 1:1; from about 10:1 to about 1:1; and from about 5:1 to about 1:1.

In the event that a mixture of alkyl polyglycoside and polymeric surfactant is employed, the ratio by weight of ethoxylated nonionic surfactant to anti-gelling agent mixture will range from about 20:1 to about 1:1; from about 15:1 to about 1:1; from about 10:1 to about 1:1; and from about 5:1 to about 1:1.

The present invention will be better understood from the examples which follow, all of which are intended for illustrative purposes only and are not meant to unduly limit the scope of the invention in any way.

EXAMPLES

Example 1

The data below shows the affect of a $C_{8-10}$ alkyl polyglycoside having an average degree of polymerization of 1.5, commercially available under the tradename GLUCOPON® 220UP to reduce the viscosity and dissolution of a $C_{12-15}$ 7EO LAE commercially available under the tradename NEODOL® 25-7 when mixed in ratios of 4:1 to 1.67:1 actives LAE:APG. Reducing the viscosity of these highly concentrated blends as well as the dissolution time of the surfactant mixture in water is a good indicator that gelling is reduced as well.

| | Composition | | | | | | | |
|---|---|---|---|---|---|---|---|---|
| Sample | 49-1 | 49-2 | 49-3 | 49-4 | 49-5 | 51-1 | 51-2 | 51-3 |
| NEODOL ® 25-7 | 80.00 | 64.00 | 60.00 | 53.34 | 50.00 | 60.00 | 48.00 | 45.00 |
| GLUCOPON ® 220UP (as is) | — | 26.67 | 33.33 | 44.44 | 50.00 | — | 20.00 | 25.00 |
| Water | 20.00 | 9.33 | 6.67 | 2.22 | — | 40.00 | 32.00 | 30.00 |
| Total | 100.00 | 100.00 | 100.00 | 100.00 | 100.00 | 100.00 | 100.00 | 100.00 |

| Sample | 51-4 | 51-5 | 55-1 | 55-2 | 55-3 | 55-4 | 55-5 |
|---|---|---|---|---|---|---|---|
| NEODOL ® 25-7 | 40.01 | 37.50 | 50.00 | 40.00 | 37.50 | 33.34 | 31.25 |

-continued

| | | | | | | | |
|---|---|---|---|---|---|---|---|
| GLUCOPON ® 220UP (as is) | 33.33 | 37.50 | — | 16.67 | 20.83 | 27.78 | 31.25 |
| Water | 26.67 | 25.00 | 50.00 | 43.33 | 41.67 | 38.89 | 37.50 |
| Total | 100.00 | 100.00 | 100.00 | 100.00 | 100.00 | 100.00 | 100.00 |

Data

| Sample | 49-1 | 49-2 | 49-3 | 49-4 | 49-5 | 51-1 | 51-2 | 51-3 |
|---|---|---|---|---|---|---|---|---|
| Activity | 80.00 | 80.00 | 80.00 | 80.00 | 80.00 | 60.00 | 60.00 | 60.00 |
| Active Ratio 25-7/220UP | 1/0 | 4/1 | 3/1 | 2/1 | 1.67/1 | 1/0 | 4/1 | 3/1 |
| Viscosity (cPs) | 107200 | 64000 | 4000 | 536 | 612 | 28800 | 504 | 460 |
| Temperature (° C.) | 25.00 | 25.00 | 25.00 | 25.00 | 25.00 | 31.0 | 31.0 | 31.0 |
| Dissolution Rate Average (sec.) | — | — | — | — | — | 1242 | 427 | 540 |

| Sample | 51-4 | 51-5 | 55-1 | 55-2 | 55-3 | 55-4 | 55-5 |
|---|---|---|---|---|---|---|---|
| Activity | 60.00 | 60.00 | 50.00 | 50.00 | 50.00 | 50.00 | 50.00 |
| Active Ratio 25-7/220UP | 2/1 | 1.67/1 | 1/0 | 4/1 | 3/1 | 2.1 | 1.67/1 |
| Viscosity (cPs) | 684 | 2380 | 221 | 464 | 474 | 520 | 438 |
| Temperature (° C.) | 31.0 | 31.0 | 40.0 | 40.0 | 40.0 | 40.0 | 40.0 |
| Dissolution Rate Average (sec.) | 136 | 240 | 765 | 173 | 207 | 212 | 201 |

Example 2

The data below shows the affect of DEHYPOUND™ ST-15, a polymeric surfactant in accordance with the present invention, to reduce dissolution time of $C_{12-15}$ 7EO LAE (NEODOL® 25-7) when mixed in ratios of 9:1 to 3:1 actives LAE:polymeric surfactant as compared to a well known and effective gel reducing co-solvent Hexylene Glycol. Reducing the dissolution time of the surfactant mixture in water is a good indicator that gelling is reduced as well.

| | Sample ID# | | | | | | | |
|---|---|---|---|---|---|---|---|---|
| | 58-1 | 58-4 | 58-8 | 58-3 | 59-1 | 59-2 | 66-1 | 66-2 |
| NEODOL ® 25-7 | 100.0 | 85.0 | 80.0 | 75.0 | 90.0 | 85.0 | 80.0 | 75.0 |
| Hexylene Glycol | — | 15.0 | 20.0 | 25.0 | — | — | — | — |
| DEHY-DRAN ® ST-15 | — | — | — | — | 10.0 | 15.0 | 20.0 | 25.0 |
| Dissolution Rate (seconds) | 1116 | 397 | 140 | 10 | 198 | 45 | 16 | <10.0 |

Example 3

Active Mixtures of GLUCOPON® 220/DEHYPOUND™ ST-15 evaluated at 85% total active in water.

| GLUCOPON 220 | LAE 25-7 | STAR | Dissolution Time (sec) | Viscosity (cPs) |
|---|---|---|---|---|
| 8.75 | 83.75 | 7.50 | 189.0 | 201 |
| 0.00 | 92.07 | 7.93 | 221.0 | 178 |
| 0.00 | 100.0 | 0.00 | 548.0 | 500 |

The data indicates that adding increasing amounts of an alkyl polyglycoside and/or a polymeric surfactant to a $C_{12-15}$ 7EO LAE (NEODOL® 25-7) reduces the dissolution rate more effectively than a co-solvent such as Hexylene Glycol.

According to another embodiment of the present invention, there is provided a process for inhibiting an ethoxylated nonionic surfactant, present in a detergent composition, from gelling upon hydration, the process involving: (a) providing a detergent composition containing an ethoxylated nonionic surfactant; (b) providing an anti-gelling agent selected from the group consisting of an alkyl polyglycoside corresponding to formula I;

$$R^1O(Z)_a \quad \text{(I)}$$

wherein $R^1$ is a monovalent organic radical having from about 8 to about 16 carbon atoms; Z is a glucose residue; a is a number having a value from about 1.3 to about 1.6; a polymeric surfactant comprising at least one product of the reaction between: (I) at least one linking agent of formula II:

$$R^2(Y)_3 \quad \text{(II)}$$

wherein each Y group Is a halogen atom or one Y group is a halogen atom and two Y groups with two adjacent carbon atoms in the $R^2$ group and an oxygen atom form an epoxy group, and $R^2$ is an aikanetriyl group containing from 3 to 10 carbon atoms; and (ii) at least one compound of formula (III)

$$R^3(EO)_n(PO)_m(BO)_pX \quad \text{(III)}$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and pare independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component (i) to component (ii) is from about 0.2/1 to about 5/1; an alkyl sulfate; and mixtures thereof; and (c) combining the ethoxylated nonionic surfactant and anti-gelling agent prior to its introduction into water. The ethoxylated nonionic surfactant and anti-gelling agent will be combined in a ratio by weight of from about 20:1 to about 1:1; from about 15:1 to about 1:1; from about 10:1 to about 1:1; from about 5:1 to about 1:1.

Reducing the gelling tendency of detergent compositions containing concentrated amounts of ethoxylated nonionic surfactants such as LAE and/or NPE based detergents is important for various cleaning product applications. Examples:

Heavy Duty Laundry powders and liquids; surfactant gelling slows down dissolution rate of detergent when hydrated resulting in poor cleaning performance and residues.

Laundry Tablets; surfactant gelling in these new product forms (growing quickly in Europe and soon to be launched in the US) inhibits the direct contact of water with the disintegration agents that swell and help break up the tablet for rapid dissolution. LAE (or NPE) when hydrated will gel and encapsulate the disintegration agents. These disintegration agent (e.g. swelling cellulosic polymers) require contact with water to expand. Therefore it is desirable to reduce or eliminate the gelling affect of these nonionic surfactants.

Liquid Laundry "Tablets" or pouches; the newest laundry detergent products recently launched in Europe. These detergent products are based on highly active surfactant systems (nonionic based) with minimal water content. Reducing the gelling tendency of these products is also critical to optimal cleaning.

Processing aid for aqueous based liquid surfactant products; surfactant gelling during the processing of liquid products will significantly slow down process time which adds costs. Reducing the gelling affect/increasing the dissolution rate is desirable in order to reduce processing costs.

What is claimed is:

1. A process for inhibiting tablet-form laundry detergents from gelling upon hydration comprising:

(a) providing a detergent formulation containing a surfactant component selected from the group consisting of an anionic surfactant, a nonionic surfactant, and mixtures thereof, and wherein the surfactant component is present in an amount of from about 31 to 80% by weight, based on the weight of the detergent formulation:

(b) providing an anti-gelling agent selected from the group consisting of an alkyl polyglycoside corresponding to formula I:

$$R^1O(Z)_a \quad \text{(I)}$$

wherein $R^1$ is a monovalent organic radical having from about 6 to about 30 carbon atoms; Z is a glucose residue; a is a number having a value from about 1 to about 6; a polymeric surfactant comprising at least one product of the reaction between:

(i) at least one linking agent of formula II:

$$R^1(Y)_3 \quad \text{(II)}$$

wherein each Y group is a halogen atom or one Y group is a halogen atom and two Y groups with two adjacent carbon atoms in the $R^2$ group and an oxygen atom form an epoxy group, and $R^2$ is an alkanetriyl group containing from 3 to 10 carbon atoms; and (ii) at least one compound of formula (III)

$$R^3(EO)_n(PO)_m(BO)_pX \quad \text{(III)}$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component (i) to component (ii) is from about 0.2/1 to about 5/1; and mixtures thereof;

(c) combining the detergent formulation and the anti-yelling agent to form a finished formulation and;

(d) processing the finished formulation into a tablet-form laundry detergent product.

2. The process of claim 1 wherein the surfactant component is an anionic surfactant.

3. The process of claim 1 wherein the surfactant component is a nonionic surfactant.

4. The process of claim 1 wherein the anti-gelling agent is an alkyl polyglycoside corresponding to formula I:

$$R^1O(Z)_a \quad \text{(I)}$$

wherein $R^1$ is a monovalent organic radical having from about 6 to about 30 carbon atoms; Z is a glucose residue; a is a number having a value from about 1 to about 6.

5. The process of claim 4 wherein in formula I, $R^1$ is a monovalent organic radical having from about 8 to about 11 carbon atoms, and a is a number of about 1.5.

6. The process of claim 4 wherein the surfactant component and the alkyl polyglycoside are combined in a ratio by weight of from about 20:1 to about 1:1.

7. The process of claim 4 wherein the surfactant component and the alkyl polyglycoside are mixed in a ratio by weight of from about 10:1 to about 1:1.

8. The process of claim 4 wherein the surfactant component and the alkyl polyglycoside are mixed in a ratio by weight of from about 5:1 to about 1:1.

9. The process of claim 1 wherein the anti-gelling agent is the polymeric surfactant.

10. The process of claim 9 wherein the polymeric surfactant is the reaction product of epichlorohydrin with a linear alcohol ethoxylate having from about 8 to about 10 carbon atoms, and about 4 moles of ethylene oxide.

11. The process of claim 9 wherein the surfactant component and the polymeric surfactant are mixed in a ratio by weight of from about 20:1 to about 1:1.

12. The process of claim 9 wherein the surfactant component and the polymeric surfactant are mixed in a ratio by weight of from about 10:1 to about 1:1.

13. The process of claim 9 wherein the surfactant component and the polymeric surfactant are mixed in a ratio by weight of from about 5:1 to about 1:1.

14. The process of claim 1 wherein the anti-gelling agent is a mixture of an alkyl polyglycoside and a polymeric surfactant.

15. The process of claim 14 wherein the ratio by weight of surfactant component to anti-gelling agent is from about 20:1 to about 1:1.

16. The process of claim 14 wherein the ratio by weight of surfactant component to anti-gelling agent is from about 10:1 to about 1:1.

17. The process of claim 14 wherein the ratio by weight of surfactant component to anti-gelling agent is from about 5:1 to about 1:1.

18. The process of claim 1 wherein the tablet-form detergent product is a solid tablet.

19. The process of claim 1 wherein the tablet-form detergent product is a concentrated liquid detergent formulation present inside a water-soluble outer covering.

20. A process for inhibiting a tablet-form laundry detergent composition containing an ethoxylated nonionic surfactant from gelling upon hydration comprising:

(a) providing an ethoxylated nonionic surfactant in an amount of from about 31 to 80% by weight, based on the weight of the composition;

(b) providing an anti-gelling agent selected from the group consisting of an alkyl polyglycoside corresponding to formula I:

$$R^1O(Z)_a \quad (I)$$

wherein $R^1$ is a monovalent organic radical having from about 8 to about 11 carbon atoms; Z is a glucose residue; a is a number having a value of about 1.5; a polymeric surfactant comprising at least one product of the reaction between:

(i) at least one linking agent of formula II:

$$R^2(Y)_3 \quad (II)$$

wherein each Y group is a halogen atom or one Y group is a halogen atom and two Y groups with two adjacent carbon atoms in the $R^2$ group and an oxygen atom form an epoxy group, and $R^2$ is an alkanetriyl group containing from 3 to 10 carbon atoms; and (ii) at least one compound of formula (III)

$$R^3(EO)_n(PO)_m(BO)_pX \quad (III)$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component (i) to component (ii) is from about 0.2/1 to about 5/1; and mixtures thereof; and (c) combining the ethoxylated nonionic surfactant with the anti-yelling agent to form a tablet-form laundry detergent product, prior to its introduction into water.

21. The process of claim 20 wherein the ethoxylated nonionic surfactant is selected from the group consisting of a linear alcohol ethoxylate having from about 8 to about 20 carbon atoms, and from about 1 to about 20 moles of ethylene oxide, a nonyl-phenol ethoxylate having from about 1 to about 20 moles of ethylene oxide, and mixtures thereof.

22. The process of claim 20 wherein the anti-gelling agent is an alkyl polyglycoside corresponding to formula I:

$$R^1O(Z)_a \quad (I)$$

wherein $R^1$ is a monovalent organic radical having from about 8 to about 11 carbon atoms; Z is a glucose residue; a is a number having a value of about 1.5.

23. The process of claim 22 wherein the ethoxylated nonionic surfactant and the alkyl polyglycoside are combined in a ratio by weight of from about 20:1 to about 1:1.

24. The process of claim 22 wherein the ethoxylated nonionic surfactant and the alkyl polyglycoside are mixed in a ratio by weight of from about 10:1 to about 1:1.

25. The process of claim 22 wherein the ethoxylated nonionic surfactant and the alkyl polyglycoside are mixed in a ratio by weight of from about 5:1 to about 1:1.

26. The process of claim 20 wherein the anti-gelling agent is the polymeric surfactant.

27. The process of claim 26 wherein the polymeric surfactant is the reaction product of epichlorohydrin with a linear alcohol ethoxylate having from about 8 to about 10 carbon atoms, and about 4 moles of ethylene oxide.

28. The process of claim 26 wherein the ethoxylated nonionic surfactant and the polymeric surfactant are mixed in a ratio by weight of from about 20:1 to about 1:1.

29. The process of claim 26 wherein the ethoxylated nonionic surfactant and the polymeric surfactant are mixed in a ratio by weight of from about 10:1 to about 5:1.

30. The process of claim 26 wherein the ethoxylated nonionic surfactant and the polymeric surfactant are mixed in a ratio by weight of from about 5:1 to about 1:1.

31. The process of claim 20 wherein the anti-gelling agent is a mixture of an alkyl polyglycoside and a polymeric surfactant.

32. The process of claim 31 wherein the ratio by weight of nonionic ethoxylated surfactant to anti-gelling agent is from about 20:1 to about 1:1.

33. The process of claim 31 wherein the ratio by weight of nonionic ethoxylated surfactant to anti-gelling agent is from about 10:1 to about 1:1.

34. The process of claim 31 wherein the ratio by weight of nonionic ethoxylated surfactant to anti-gelling agent is from about 5:1 to about 1:1.

35. A process for inhibiting tablet-form laundry detergents from galling upon hydration comprising:

(a) providing a detergent formulation containing a surfactant component selected from the group consisting of an anionic surfactant, a nonionic surfactant, and mixtures thereof;

(b) providing an anti-yelling agent containing a polymeric surfactant comprising at least one product of the reaction between: (i) at least one linking agent of formula II:

$$R^2(Y)_3 \quad (II)$$

wherein each Y group is a halogen atom or one Y group is a halogen atom and two Y groups with two adjacent carbon atoms in the $R^2$ group and an oxygen atom form an epoxy group, and $R^2$ is an alkanetriyl group containing from 3 to 10 carbon atoms; and (ii) at least one compound of formula (III)

$$R^3(EO)_n(PO)_m(BO)_pX \quad (III)$$

wherein $R^3$ is a substituted or unsubstituted saturated or unsaturated, aliphatic oxy or thio group having from 1 to about 36 carbon atoms or a secondary amino group having from 2 to about 36 carbon atoms; n, m, and pare independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component (I) to component (II) is from about 0.2/1 to about 5/1; and mixtures thereof;

(c) combining the detergent formulation and the anti-gelling agent to form a finished formulation and;

(d) processing the finished formulation into a tablet-form laundry detergent product.

36. A process for inhibiting a detergent composition containing an ethoxylated nonionic surfactant from gelling upon hydration comprising:

(a) providing an ethoxylated nonionic surfactant;

(b) providing an anti-gelling agent containing a polymeric surfactant comprising at least one product of the reaction between:

(i) at least one linking agent of formula II:

$$R^2(Y)_3 \quad \text{(II)}$$

wherein each Y group is a halogen atom or one Y group is a halogen atom and two Y groups with two adjacent carbon atoms in the $R^2$ group and an oxygen atom form an epoxy group, and $R^2$ is an alkanetriyl group containing from 3 to 10 carbon atoms; and (ii) at least one compound of formula (III)

$$R^3(EO)_n(PO)_m(BO)_pX \quad \text{(III)}$$

wherein $R^3$ is a substituted or unsubstituted saturated or unsaturated, aliphatic oxy or thio group having from 1 to about 36 carbon atoms or a secondary amino group having from 2 to about 36 carbon atoms; a, m, and p are independently numbers of from 0 to about 50; X is hydrogen, or a mercapto group or an amino group in place of a terminal —OH group, provided that when X is mercapto or amino, the sum of n, m, and p must be at least 1; and wherein the mole ratio of component (i) to component (ii) is from about 0.2/1 to about 5/1; and mixtures thereof; and (c) combining the ethoxylated nonionic surfactant with the anti-gelling agent, prior to their introduction into water.

* * * * *